US005485144A

United States Patent [19]

Amleshi et al.

[11] Patent Number: 5,485,144

[45] Date of Patent: Jan. 16, 1996

[54] COMPENSATED IONIZATION SENSOR

[75] Inventors: Perrouz Amleshi, St. Charles; Hsing G. Jen, Buffalo Grove; William MacPherson, West Chicago; Lee D. Tice, Bartlett, all of Ill.

[73] Assignee: Pittway Corporation, Chicago, Ill.

[21] Appl. No.: 59,807

[22] Filed: May 7, 1993

[51] Int. Cl.[6] ..... G08B 17/10

[52] U.S. Cl. ..... 340/629; 73/23.2; 250/381

[58] Field of Search ..... 73/23.2; 340/629; 250/381

[56] References Cited

U.S. PATENT DOCUMENTS

| | | | |
|---|---|---|---|
| Re. 30,117 | 10/1979 | Scheidweiler et al. | 250/381 |
| 3,731,093 | 5/1973 | Scheidweiler et al. | 250/44 |
| 3,935,492 | 1/1976 | Sasaki et al. | 313/54 |
| 4,041,479 | 8/1977 | Miyabe | 340/237 |
| 4,044,262 | 8/1977 | Minowa | 250/381 |
| 4,058,803 | 11/1977 | Scheidweiler | 340/237 |
| 4,189,644 | 2/1980 | Schubert et al. | 250/381 |
| 4,234,877 | 11/1980 | Maruyama et al. | 340/629 |
| 4,396,840 | 8/1983 | Araki et al. | 250/381 |
| 4,456,907 | 6/1984 | Johnson | 340/629 |
| 4,488,044 | 12/1984 | Rork et al. | 250/381 |
| 4,582,996 | 4/1986 | Scheidweiler et al. | 250/385 |
| 4,594,512 | 6/1986 | Sasaki | 250/384 |
| 4,740,703 | 4/1988 | Inamura | 250/385.1 |
| 4,786,811 | 11/1988 | Sasaki | 250/385.1 |
| 4,914,425 | 4/1990 | Kaminaka et al. | 340/693 |

FOREIGN PATENT DOCUMENTS

| | | |
|---|---|---|
| 58-32832 | 10/1975 | Japan . |
| 58-35819 | 12/1976 | Japan . |

*Primary Examiner*—John K. Peng
*Assistant Examiner*—Edward Lefkowitz
*Attorney, Agent, or Firm*—Dressler, Goldsmith, Shore & Milnamow, Ltd.

[57] ABSTRACT

A compensated ionization-type sensor includes spaced apart active and reference electrodes. A center electrode is disposed between the active reference electrodes. A compensating electrode is disposed adjacent to the center electrode and, capacitively coupled thereto. The compensating electrode is electrically coupled to the active electrode. A compensating screen with a selected potential applied thereto surrounds the electrodes to compensate for velocity of the ambient atmosphere.

2 Claims, 4 Drawing Sheets

FIG. 1
PRIOR ART
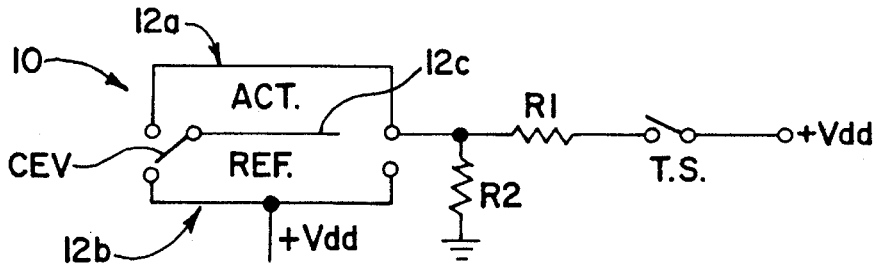
FIG. 2A
FIG. 2B
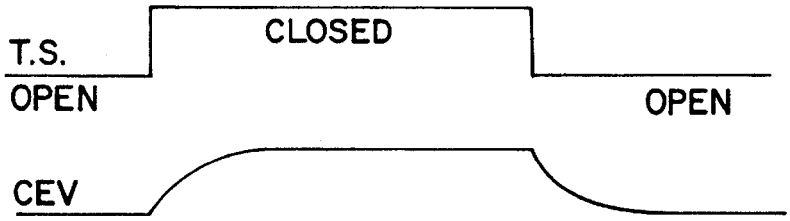
FIG. 3
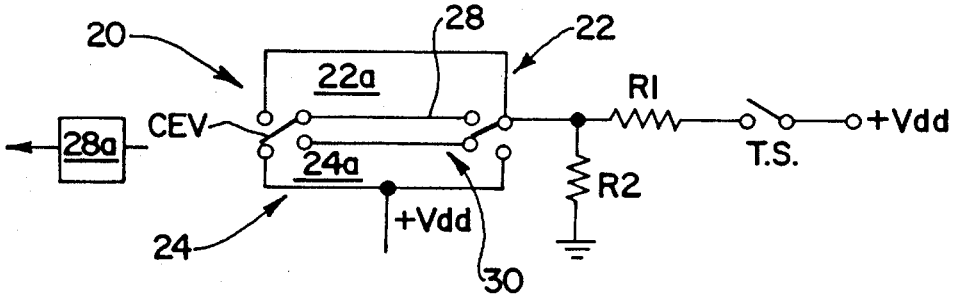
FIG. 4A
FIG. 4B
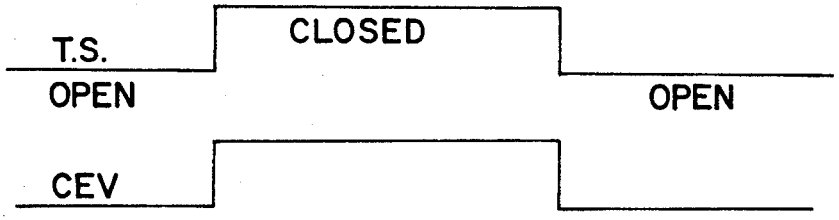

COMPENSATED IONIZATION SENSOR

FIELD OF THE INVENTION

The invention pertains to ionization-type smoke detection units. More particularly, the invention pertains to compensated ionization chambers which provide improved performance.

BACKGROUND OF THE INVENTION

Ionization-type smoke sensors are known and are recognized as being effective for providing an early warning of the presence of smoke or products of combustion. As illustrated in FIG. 1 a known sensor 10 includes an active chamber electrode 12*a* which is positioned adjacent to a reference chamber electrode 12*b*. Disposed between the electrodes 12*a* and 12*b* is an intermediate or sensing electrode 12*c*. The unit 10 includes minute quantities of radioactive material which function as a source of ions in a known fashion.

It is also known to test such detectors by applying a test voltage to the active chamber electrode 12*a*. This test voltage can be applied via a test switch TS which can be automatically or manually operated, in combination with resisters R1 and R2.

FIGS. 2A and 2B are graphs illustrating application of a test voltage to the chamber via the test switch TS, as well as the response of the intermediate electrode 12*c* to the applied test voltage. As the graphs in FIGS. 2A and 2B illustrate while the applied test voltage may be a pulse having relatively very short rise and fall times the voltage response CEV of the intermediate electrode 12*c* has exponential rise and fall times due to large impedance values associated with ionization sensors, as well as stray capacitances.

As a result of the exponential rise and falls times of the voltage CEV of the intermediate electrode 12*c* there is a delay between when the test voltage is applied by the test switch TS and when its effects can be detected at the output of the intermediate electrode 12*c*. This delay in turn imposes upper limits on how fast the test function can be carried out.

Speed of execution of the test function becomes particularly important in modern fire alarm systems which may include hundreds of ionization-type sensing units coupled to a central control panel via common communication lines. In such instances the central control panel may on a regular basis test some or all of the sensing units. Where the system includes three or four hundred detectors delays which are insignificant with just a few detectors become highly undesirable.

Thus, there continues to be a need for ionization-type smoke sensors which have shorter response times. Preferably response times in the test mode could be shortened without significantly increasing the cost of the sensors.

Additionally, there continues to be an ongoing problem with the response of known smoke detectors in the presence of varying velocities of ambient air. Most modern commercial or industrial facilities include building-wide heating/cooling systems which regularly circulate the air through the building and condition it so that it remains comfortably warm in the winter and comfortably cool in the summer.

The forced movement of the ambient atmosphere, and the resulting velocity thereof, is known to have a negative impact on the performance of smoke detectors. Due to the movement of air it may take longer for the smoke density to increase to a sufficient level so as to produce a potential alarm condition.

There thus continues to be a need for detectors which do not exhibit an inordinate drop in sensitivity as a function of air velocity. Preferably compensating for air velocity could be achieved also without materially increasing the cost of the detector.

SUMMARY OF THE INVENTION

In accordance with the invention a compensated ionization-type smoke sensor has a shorter response time to an applied test voltage than does a similar non-compensated sensor. The compensated sensor includes a housing which supports first and second spaced apart active and reference electrodes. Disposed between the two electrodes is a center electrode. Each of the active and the reference electrodes in combination with the center electrode define an active region and a reference region of the sensor respectively.

A capacitively coupled, compensating member is disposed in or adjacent to one of the active region or the reference region. This member is capacitively coupled to the center electrode. The compensating member has an applied electrical potential. It, for example, can be electrically coupled to the active electrode, if located in or adjacent the reference chamber or coupled to the reference electrode if located in or adjacent to the active chamber.

A pulse-like test voltage applied to the active electrode, for example, produces a fast-pulse like response at the center electrode. This response does not have an extended rise or fall time.

Further, in accordance with the invention, the sensor can be compensated for velocity of ambient air by providing a surrounding conductive structure. The structure is coupled to a selected electrical potential, different from that applied to the active chamber electrode. The surrounding structure can include a metal screen.

The structure surrounding the detector contributes to and helps to form a serpentine path into the active chamber. This path also contributes to minimizing the effect of air velocity on detector sensitivity.

These and other aspects and attributes of the present invention will be discussed with reference to the following drawings and accompanying specification.

BRIEF DESCRIPTION OF THE DRAWINGS

FIG. 1 is a side sectional, schematic, view of a known ionization-type smoke detector;

FIG. 2A is a graph illustrating an applied test voltage;

FIG. 2B is a graph illustrating response of a center electrode of the detector of FIG. 1 to the applied test voltage of FIG. 2A;

FIG. 3 is a side sectional, schematic, view of a compensated detector in accordance with the present invention;

FIG. 4A is a graph illustrating a test voltage applied to the compensated chamber of FIG. 3;

FIG. 4B is a graph illustrating response of the center electrode of the compensated chamber of FIG. 3 to the test voltage of FIG. 4A;

DETAILED DESCRIPTION OF THE PREFERRED EMBODIMENT

Figure 5:
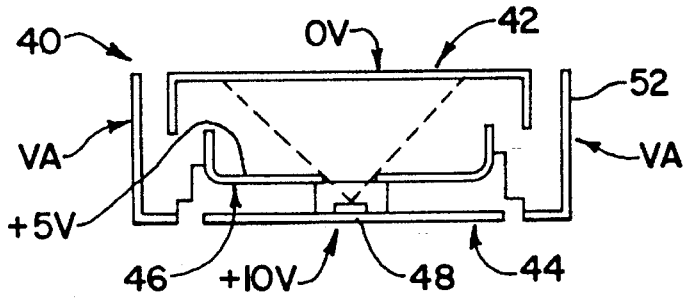
FIG. 5 is a side sectional, schematic, view of another compensated ionization-type smoke sensor in accordance with the present invention.

While this invention is susceptible of embodiment in many different forms, there are shown in the drawing, and will be described herein in detail, specific embodiments thereof with the understanding that the present disclosure is to be considered as an exemplification of the principles of the invention and is not intended to limit the invention to the specific embodiments illustrated.

It has been determined that improved performance can be achieved in an ionization-type smoke detector by introducing an additionally, capacitively coupled, conducting member into the ionization chamber. This additional member improves the response of the center electrode to an applied test voltage.

FIG. 3 illustrates a smoke detector 20 which embodies the present invention. The detector 20 includes an active chamber electrode 22 and a reference chamber electrode 24. A potential is applied between the electrode elements 22 and 24 in a known fashion.

The electrode elements 22 and 24 can be carried by a housing and form an active chamber 22*a* and a reference chamber 24*a*. A central electrode 28 is disposed between the active chamber 22*a* and the reference chamber 24. Electrical circuitry 28*a* can be coupled to the center electrode 28 in a known fashion so as to detect an increased smoke density in the active chamber 22*a*.

A capacitively coupled conductive member 30 is positioned within the chamber 20 to improve performance of the Center Electrode Voltage CEV, in response to closing the test switch TS. The member 30 is capacitively coupled to the center electrode 28 and is electrically coupled to the active chamber electrode 22.

The graphs of FIGS. 4A and 4B illustrate improved performance of the chamber 20. FIG. 4A is a graph of the test voltage applied to the electrode 22 in response to the switch TS being closed and then opened again. Graph 4B illustrates the change in CEV in response to the test voltage being applied to the electrode 22.

As illustrated in FIG. 4B the chamber 20 has a response which is substantially faster than the response of the prior art chamber 10. Thus, the use of the capacitively coupled member 30 improves the response time of the center electrode voltage.

The chamber 20 is well suited for use in fire alarm systems of a type having a central control unit and a distributed plurality of detectors. The central control unit communicates with the detectors via communication lines and is periodically able to test the functionality of the various detectors. The use of the chamber 20 in such systems, which may include hundreds of smoke detectors, speeds the process of testing the detectors. The test function can be carried out at a much higher rate than heretofore possible.

It will be understood that the member 30 can assume a variety of shapes, such as planar or non-planar. The member 30 can be located at a variety of locations. In addition, it need not be coupled directly to the active chamber electrode 22. A different potential can be applied thereto. Thus, the shape, location or potential applied to the compensating capacitively coupled member 30 are not limitations of the present invention.

FIG. 5 illustrates an alternate compensated chamber 40. The chamber 40 incorporates a surrounding conductive structure with an electrical potential applied thereto to alter the electrical fields within the chamber. This produces improved performance of the chamber where the ambient air is moving with a nonzero velocity.

The detector 40 includes an active chamber electrode 42 and a reference chamber electrode 44. Disposed between the active chamber 42 and the reference chamber 44 is a center electrode 46. An ionization source 48 is carried on the reference chamber electrode 44.

Surrounding the chamber 40 is a conductive electrical structure 52. The structure 52 can be a solid cylindrical structure for example, or it may be formed all or in part of a conducting metal screen.

Electrical potentials are applied between the active chamber electrode 42 and the reference chamber electrode 44 in a known fashion. A separate potential is applied to the surrounding structure 52. In the chamber 40 the structure 52 is electrically coupled to the center electrode 46.

Figure 6A:
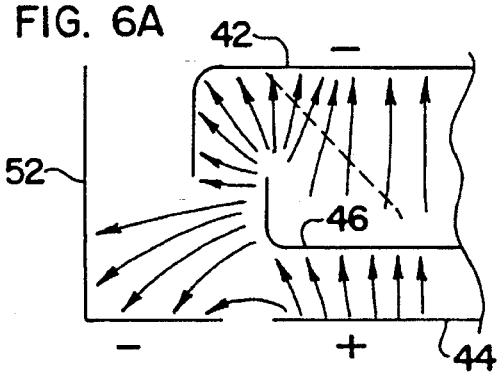
FIGS. 6A and 6B illustrate alternate electric fields within the detector of FIG. 5 in response to different compensating voltages.
Figure 6B:
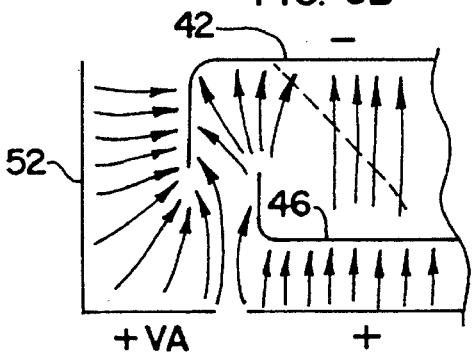

The structure 52 alters the field distribution in the chamber. FIG. 6A illustrates exemplary electrical field lines where the voltage applied to the surrounding structure 52 is negative with respect to the voltage applied to the reference chamber electrode 44. FIG. 6B illustrates exemplary field lines where the voltage applied to the surrounding structure 52 is positive with respect to the voltage applied to the active chamber electrode 42.

Figure 7:
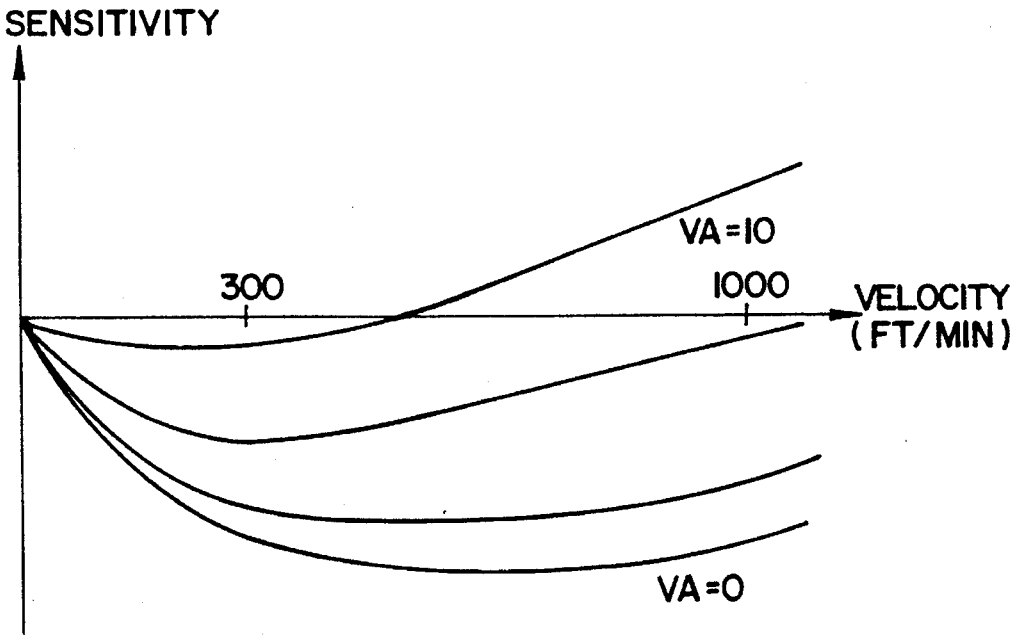
FIG. 7 is a graph illustrating sensitivity of the detector of FIG. 5 as a function of air velocity and different applied compensating voltages.

FIG. 7 is a graph of the response or sensitivity of the chamber 40 plotted as a function of velocity of smoke therein for different voltages applied to the surrounding structure 52. As illustrated in FIG. 7 applying a 10 volt potential between the surrounding structure 52 and the active chamber electrode 42 substantially improves the performance even in the presence of smoke with substantial velocities.

It will be understood that detailed exact physical characteristics of the surrounding structure 52 are not a limitation of the present invention.

Figure 8:
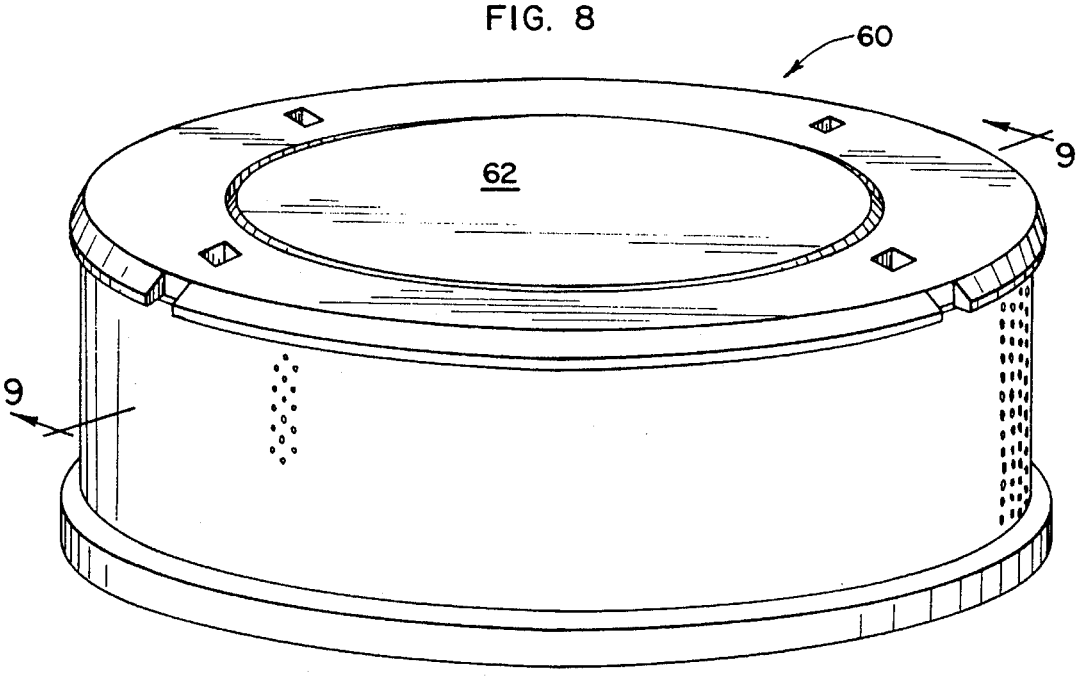
FIG. 8 is a perspective view of a compensated detector in accordance with the present invention.
Figure 9:
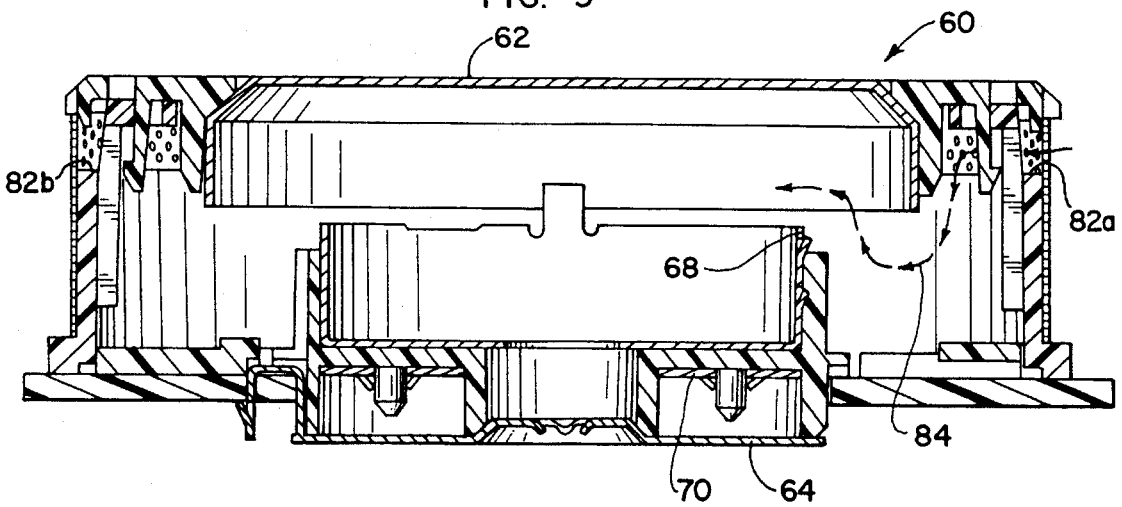
FIG. 9 is a sectional view taken along plane 9—9 of FIG. 8.
Figure 10:
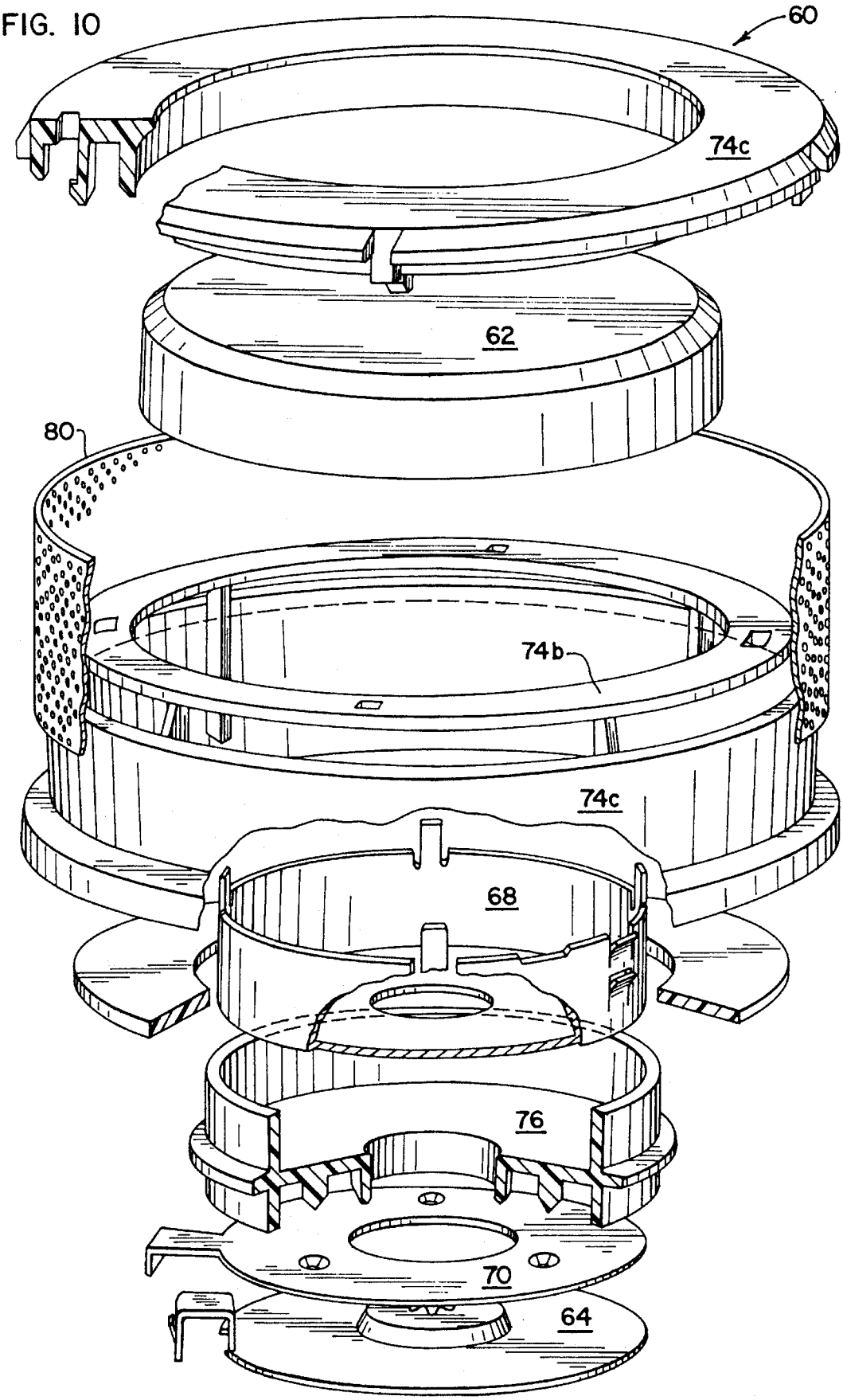
FIG. 10 is an exploded view of the compensated detector of FIG. 8.

FIGS. 8 through 10 illustrate details of a compensated ionization-type sensor 60. The sensor 60 includes a capacitively coupled compensating element, such as the element 30 of the sensor 20, as well as a surrounding conductive structure, such as the structure 52 of the sensor 40.

The sensor 60 includes an active chamber electrode 62 and a reference chamber electrode 64 spaced apart therefrom. A central electrode 68 is disposed between the active chamber electrode 62 and reference chamber electrode 64. A compensating conductive member 70 is disposed between the center electrode 68 and the reference electrode 64. The compensating member 70 is capacitively coupled to the central electrode 68. The compensating member 70 is adjacent to the intermediate electrode 68 and outside both of the reference and the active chambers.

The center electrode 68 can be electrically coupled to an output electrical circuit 28*a* for purposes of sensing the voltage CEV, thereon.

The elements 62 through 70 are supported by a housing including a cylindrical insulating member 74*a*, as well as annular support members 74*b* and 74*c*. An insulative, annular support and spacing member 76 supports the center electrode 68, the compensating element 70 and the reference electrode 64 in spaced relationship with respect to one another.

A cylindrical perforated conducting screen 80 surrounds the housing member 74*a*, as well as the elements 62 through 70. An electrical potential applied thereto is effective to alter the electric fields within the sensor which improves performance of the function of air velocity as discussed previously with respect to the chamber 40.

Input ports, such as the ports 82*a* and 82*b* are provided in the housing structure 74*a* through 74*c* in combination with the conductive screen 80. As a result, a serpentine path 84 is created which also contributes to a minimization of the flow velocity within the sensor 60.

The sensor 60 exhibits improved response to an applied test voltage, as does the sensor 20 previously discussed and also exhibits improved performance in the presence of varying air velocities as does the sensor 40 previously discussed. It will be understood that the exact details of the structure of the screen 80, as well as the conductive elements 62 through 70 are not limitations of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A compensated smoke detector with a predetermined characteristic comprising:

a housing;

a compensated smoke sensor carried by said housing, said sensor including an active electrode, a reference electrode, an intermediate electrode and a compensating electrode directly electrically connected to said active electrode and capacitively coupled to said intermediate electrode; and an output electrical device coupled to said intermediate electrode.

2. A smoke detector as in claim 1 including a test circuit coupled to at least said active electrode for applying a test voltage thereto for a predetermined period of time and wherein said intermediate electrode, responsive to said compensating electrode, provides a representation of said test voltage with substantially no delay.

* * * * *